United States Patent [19]

Sirinyan et al.

[11] Patent Number: 4,493,861

[45] Date of Patent: Jan. 15, 1985

[54] PROCESS FOR ACTIVATING SUBSTRATE SURFACES FOR CURRENTLESS METALLIZATION

[75] Inventors: Kirkor Sirinyan, Leverkusen; Henning Giesecke, Cologne; Gerhard D. Wolf, Dormagen; Harold Ebneth; Rudolf Merten, both of Leverkusen, all of Fed. Rep. of Germany

[73] Assignee: Bayer Aktiengesellschaft, Leverkusen, Fed. Rep. of Germany

[21] Appl. No.: 449,043

[22] Filed: Dec. 13, 1982

[30] Foreign Application Priority Data

Dec. 23, 1981 [DE] Fed. Rep. of Germany ..... 3150985

[51] Int. Cl.[3] ..... B05D 3/10

[52] U.S. Cl. ..... 427/304; 427/305; 427/306; 427/337; 427/404

[58] Field of Search ..... 427/304–306, 427/404, 337

[56] References Cited

U.S. PATENT DOCUMENTS

| | | | |
|---|---|---|---|
| 3,488,166 | 1/1970 | Kovac et al. | 427/306 |
| 3,501,332 | 3/1970 | Buckman | 427/306 |
| 3,523,824 | 8/1970 | Powers et al. | 427/306 |
| 3,560,257 | 2/1971 | Schneble et al. | 427/305 |
| 3,956,041 | 5/1976 | Polichette et al. | 427/306 |
| 3,998,602 | 12/1976 | Horowitz et al. | 427/306 |

OTHER PUBLICATIONS

IBM Technical Disclosure Bulletin, vol. 11, No. 8, Jan. 1969, New York, p. 1001, P. J. Bailey et al., "Catalysis for Electroless Copper Plating".

IBM Technical Disclosure Bulletin, vol. 5, Oct. 1970, New York, p. 1200, L. T. Romankiw, "Activation of Polymer Surfaces For Electroless Metallization".

John C. Bailar, Jr., "The Chemistry of the Coordination Compounds", 1956, pp. 487–508, (Reinhold Publishing Corporation, New York).

*Primary Examiner*—Norman Morgenstern
*Assistant Examiner*—Janyce A. Bell
*Attorney, Agent, or Firm*—Sprung, Horn, Kramer & Woods

[57] ABSTRACT

A simple and mild method of activating substrate surfaces for currentless metallization involves activating by means of organometallic compounds of elements of the 1st and 8th sub-Groups of the Periodic Table of Elements in which the organic moiety consists of oligomeric, prepolymeric or polymeric compounds containing double bonds.

8 Claims, No Drawings

PROCESS FOR ACTIVATING SUBSTRATE SURFACES FOR CURRENTLESS METALLIZATION

This invention relates to a process for activating substrate surfaces for chemical metallization.

It is known that polymer materials must be pretreated before chemical and after galvanic metallization, R. Weiner, Kunststoff-Gulvanisierung, Eugen G. Leuze Verlag, Saulgau/Württ. (1973). These pre-treatments consist mainly of etching the polymer surface, e.g. with chromosulphuric acid, simple and repeated rinsing with water, detoxication with dilute sodium bisulphite solution, further rinsing with water and the treatment of the substrate surface with a suitable activating bath, such as a palladium salt solution or a palladium sol.

Etching alters the polymer surface so that cavities and vacuoles are formed. This method may only be employed for certain polymers, e.g. diphasic multicomponent graft polymers or copolymers, such as ABS polymers, or high impact strength polystyrene, or diphasic homopolymers, such as partially crystalline polypropylene.

The use of chromosulphuric acid or other oxidants impairs the physical properties, e.g. the notched impact strength or electric surface resistance, of the basic polymer material.

Hexavalent chromium carried into the activating and metallizing baths poisons the baths.

The same disadvantages are found in processes in which the polymer surfaces are chemically altered by means of a strong gaseous oxidizing agent, e.g. hot $SO_3$ vapour.

In order that the ionogenic palladium fixed to the substrate surface may be capable of catalytic reduction of the metal ion in the chemical metallizing bath, it must be reduced to the metal. Reduction of the ionogenic palladium is carried out either in an acid tin(II) chloride bath or by the introduction of tin(II) chloride into a strong hydrochloric acid solution of palladium(II) chloride.

Since the substrate surface must be washed after reduction of the ionogenic palladium, it may be assumed that a gel of tin hydroxide is formed, which helps to fix the palladium.

In the next stage of the operation, excess protective colloid must be removed from the substrate surface in order that reduction of the metal ions, e.g. copper, nickel, gold and cobalt, in the metallizing bath may take place by the catalytic action of active palladium centres on the substrate surface.

The known processes for currentless metallization of materials thus comprise a relatively large number of steps and have the further disadvantage of being limited to those substrates which by virtue of the physical or chemical characteristics thereof are capable of being roughened by chemical or physical means.

The incorporation of compounds of elements of the 1st and 8th sub-Groups of the Periodic Table of Elements in photographic lacquers, coatings and polymer materials has been disclosed in U.S. Pat. No. 3,560,257.

It has been found, however, that under the conditions mentioned therein, no organometallic compounds are formed and only the catalytic property of palladium(II) chloride is utilized.

It was an object of the present invention to provide a new method, simple to carry out and employing mild conditions, for the activation of substrate surfaces for currentless metallization by means of which even surfaces which are difficult to metallize would be able to be provided with a firmly adhering metal coating.

This problem was solved by activation by means of organometallic compounds of palladium, the organic moiety of which consists of oligomeric, prepolymeric or polymeric compounds containing double bonds.

The present invention thus relates to a process for the activation of substrate surface for currentless metallization, in which the surface to be metallized is wetted with an organopalladium(II) compound homogeneously distributed in a solvent, in particular an organic solvent, preferably without first being etched, the solvent is removed and the organopalladium(II) compound adhering to the surface to be metallized is reduced, characterized in that the organic moiety of the organometallic compound is an oligomeric, prepolymeric or polymeric compound which contains double bonds.

The terms "oligomeric", "prepolymeric" and "polymeric" are known to those skilled in the art. They cover a range of molecular weights of from 150 to 1,000,000, preferably from 200 to 500,000.

Homo- and co-polymers of conjugated dienes, e.g. styrene-butadiene copolymers, and unsaturated polyesters are preferred organic compounds.

These compounds form $\pi$-complexes with palladium.

The metal may be attached to the oligomer, prepolymer or polymer, or it may be attached to the corresponding monomer, in which case formation of the complex would be followed by a suitable polymerization reaction. The polymerisation reaction and formation of the metal bond could also be carried out in one operation.

It is advantageous if, in addition to containing groups which bind the metal to the polymer, the oligomeric, prepolymeric or polymeric compounds contain functional groups which are capable of binding the organometallic compound to the substrate to be activated or are capable of further polymerization. Carboxyl and ester groups are examples of such groups.

To prepare the organometallic compounds to be used according to the present invention, known low molecular weight organometallic compounds are reacted with the oligomeric, prepolymeric or polymeric compounds with exchange of ligands or known organometallic compounds are reacted with low molecular weight compounds suitable for preparing polymers, this reaction being accompanied by ligand exchange, and the polymerization reaction is subsequently carried out.

The organometallic compound may be, for example, dissolved or dispersed in the organic solvent or the organometallic compound may be triturated with the solvent.

If the organometallic compound contains groups which enable it to be chemically fixed to the surface of the substrate, activation may be possible from the aqueous phase.

It is advisable to observe the following conditions when carrying out the process on a technical scale:

1. The organometallic compounds used should be stable in air and in the presence of moisture. They should be readily soluble in organic solvents, but only slightly soluble in water. They should be capable of being reduced by conventional reducing agents to a compound which is catalytically active in currentless metallization. 2. The solutions of the organometallic compounds in organic solvents should be stable in air and in the presence of moisture.

3. The organic solvent should be easily removable.

4. Reduction of the organometallic compound must not be accompanied by the release of materials which would poison the metallizing baths.

5. The reduced active nuclei should adhere firmly to the surface in aqueous solution in order to prevent decomposition of the baths by palladium carried into them.

The new process according to the present invention is generally carried out as follows:

An organopalladium compound is dissolved in an organic solvent. Mixtures of compounds may, of course, be used. The concentration should generally be from 0.01 to 10 g per liter, but may in certain cases lie above or below this range.

Suitable organic solvents include in particular polar, protic and aprotic solvents, such a methylene chloride, chloroform, 1,1,1-trichloroethane, trichloroethylene, perchloroethylene, acetone, methyl ethyl ketone, butanol, ethylene glycol and tetrahydrofuran.

Mixtures of the above solvents and mixtures with other solvents, such as petroleum hydrocarbons, ligroin, toluene, may, of course, also be used. In the process according to the present invention, the surfaces of the substrate to be metallized are wetted with such solutions and are exposed to the action thereof preferably for a period of from 1 second to 10 minutes. Methods such as immersion of the substrate in the solutions or spraying of the substrate surfaces with activator solutions are particularly suitable for this purpose. The activator solutions may, of course, also be applied by stamping or printing in accordance with the present process.

Suitable substrates for the process according to the present invention include, for example, steel, titanium, glass, quartz, ceramics, carbon, paper, polyethylene, polypropylene, ABS plastics, epoxide resins, polyesters, and textile sheet products, filaments and fibres of polyamide, polyester, polyolefins, polyacrylonitrile, polyvinyl halides, cotton, wool and mixtures of these or of copolymers of the above mentioned monomers.

After the substrates have been wetted, the organic solvents are removed. Low boiling solvents are preferably removed by evaporation, e.g. under vacuum. For higher boiling solvents, it is suitable to use other methods, such as extraction with a solvent in which the organometallic compound is insoluble.

The pre-treated surfaces must subsequently be activated by reduction, preferably using the conventional reducing agents employed in electroplating, such as hydrazine hydrate, formaldehyde, hypophosphite or boranes. Other reducing agents may, of course, be used. Reduction is preferably carried out in aqueous solution, although other solvents may also be used, such as alcohols, ethers or hydrocarbons. The reducing agents may, of course, also be used in the form of suspensions or slurries.

After activation, the surfaces may be used directly for currentless metallization, but it may be necessary first to clean the surfaces by rinsing to remove residues of reducing agent.

According to one particularly preferred embodiment of the present process, reduction is carried out in the metallizing bath, using the same reducing agent as for currentless metallization. This embodiment simplifies currentless metallization to an extent which has not hitherto been possible. This very simple procedure now involves only three operations: immersion of the substrate in the solution of organometallic compound, evaporation of the solvent and immersion of the activated surfaces in the metallizing bath (reduction and metallization).

This embodiment is particularly suitable for nickel baths containing aminoborane or copper baths containing formalin.

The metallizing baths used for the process according to the present invention are preferably baths containing nickel salts, cobalt salts, copper salts, gold and silver salts or mixtures of these with each other or with iron salts. Metallizing baths of this type are known for currentless metallization.

One particular advantage of the oligomeric, prepolymeric and polymeric organopalladium compounds is that activated shaped products may be produced from them directly, employing the conventional technology. These products may then be subjected to reduction and metallization.

The oligomeric, prepolymeric and polymeric organometallic compounds applied to substrates may, of course, be subjected to further reactions, such as cross-linking or grafting.

The same applies to shaped products produced from the metallized compounds.

The numerous possible applications of metallized articles which have been activated by the process according to the present invention prior to metallization are described in the book by R. Weiner, Kunststoff-Galvanisierung, mentioned above. Other possible applications may be found in the Examples which follow.

EXAMPLE 1

A polypropylene foil (100×80 mm) is degreased with methylene chloride, subsequently immersed for 20 seconds in a solution of 18 g of polybutadiene Pd-complex having a number average molecular weight of $\overline{M}_n = 900$ and 5.2% by weight of palladium (based on the anhydrous polybutadiene mass) in 1 l of methylene chloride, and, then after evaporation of the solvent at room temperature, the foil is subjected to currentless nickel plating for 15 minutes in a slightly alkaline aqueous nickel plating bath containing 3.5 g of dimethylaminoborane, 30 g of nickel chloride and 10 g of citric acid in 1 l, adjusted to pH 8.2 using concentrated ammonia solution. The surface of the foil darkens after about 2 minutes and a layer having a metallic sheen is observed after ca. 6 minutes. The electric resistance of the chemically deposited nickel layer is so low that if the polypropylene foil is washed after chemical metallization and then connected as cathode in a galvanic copper plating bath, it becomes coated with a layer of copper ca. 4.2 μm in thickness after 30 minutes at 1.0 Ampère. The galvanic copper plating bath is prepared from 200 g $CuSO_4.5\,H_2O$, 30 g $H_2SO_4$ (=1.84 g/cm$^3$) made up to 1 l with distilled water.

EXAMPLE 2

A glass plate (100×80 mm) is degreased with methylene chloride and then immersed for 30 seconds in a solution of 7.2 g of polybutadiene-Pd complex ing 7.1%, by weight, of palladium (based on the dry polybutadiene mass in 1 l of methylene chloride and then nickel plated at room temperature as described in Example 1 after evaporation of the solvent. After only 1 minute, the plate is covered with a fine, black layer of nickel.

After ca. 15 minutes, the layer of nickel has a thickness of 0.15 μm and may be connected as cathode in a conventional galvanic metallizing bath to be thickened.

EXAMPLE 3

A square of polyester/cotton fabric measuring 100×100 mm is immersed for 30 seconds, as described in Example 2, in a solution of 7.2 g of polybutadiene-Pd complex having a molecular weight of $\overline{M}_n=950$ and containing 7.1%, by weight, of palladium (based on the dry polybutadiene mass) in 1 l of methylene chloride, and it is then dried at room temperature and nickel plated for 20 minutes in an alkaline nickel plating bath a described in Example 1. A metallized piece of fabric covered with a layer of nickel weighing 9 g/m² is obtained.

EXAMPLE 4

0.75 g of acetonitrile palladium dichloride in 20 ml of methylene chloride are added at room temperature to 10 g of an air drying, diene-containing alkyd resin (60% by weight in xylene) having an oil content (calculated as triglyceride) of 48% by weight and the components are stirred for 20 minutes.

A glass plate (100×100 mm) is sprayed with the prepolymer solution described above ("Frigen" used as propellant), and after drying nickel plated for 9 minutes as described in Example 1.

Nickel is deposited on the surface of the substrate. This nickel is layer is reinforced to a thickness of 15 μm in a galvanic metallizing bath according to Example 1.

EXAMPLE 5

A glass fibre reinforced epoxide resin plate (100×100 mm) is sprayed with prepolymer solution containing Pd as in Example 4 and after drying of the layer, the plate is nickel plated in an alkaline nickel plating bath according to Example 1. A layer of nickel 0.1 μm in thickness is measured after 9 minutes.

EXAMPLE 6

A square of polyethylene terephthalate fabric measuring 100×100 mm is sprayed with prepolymer solution containing Pd as in Example 4 ("Frigen" as propellant) and after drying of the layer, the fabric is nickel plated according to Example 1. The fabric is covered with a fine nickel layer after only 1 minute. After 10 minutes, the quantity of chemically deposited nickel is 10 g/m².

EXAMPLE 7

0.5 g of acetonitrile palladium dichloride in 20 ml of methylene chloride is added at room temperature in the course of ca. 1 hour to 10 g of air-drying alkyd resin (60% by weight in xylene) which has an oil content (calculated as triglyceride) of 26% by weight. The mixture is subsequently concentrated to 15 ml by evaporation at room temperature in a water jet vacuum.

Glass rods having a diameter of 8 mm and a length of 250 mm are coated with the above prepolymer solution containing Pd by immersion, dried in a drying cupboard at 60° C. and then nickel plated according to Example 1.

After ca. 5 minutes, the nickel layer has a thickness of ca. 0.2 μm. The rods are removed from the bath, rinsed with distilled water and connected as cathode into a galvanic copper plating bath at 1.0 Amp. as described in Example 1 to be reinforced to 20 μm.

EXAMPLE 8

0.6 g of butadiene palladium dichloride in 20 ml of methylene chloride are added to 10 g of air-drying alkyd resin according to Example 7 in the course of about 1 hour at room temperature.

A square of wood measuring 250×250 mm is sprayed with the prepolymer solution. The lacquer layer is dried at room temperature for 12 hours and then nickel plated according to Example 1.

After ca. 5 minutes, the electric resistance of the chemical nickel layer is already so low that the wood-metal composite material may be connected as cathode into a galvanic nickel plating bath at 1.5 Amp. to be reinforced.

EXAMPLE 9

0.8 g of benzonitrile palladium dichloride in 20 ml of toluene are added to 30° C. to 10 g of the alkyd resin (60% in xylene) used in Example 7. The mixture is then concentrated to 15 ml by evaporation at room temperature in a water jet vacuum. A glass fibre reinforced epoxide resin plate is partially coated with the above-described prepolymer solution containing Pd by screen printing and then nickel plated as described in Example 1 after it has been dried in a drying cupboard at 60° C.

After only 2 minutes, the lacquer surface is selectively covered with a fine layer of nickel. After chemical metallization for ca. 5 minutes, the plate has a glossy nickel deposit on the coated areas.

EXAMPLE 10

1.0 g of butadiene palladium dichloride in 20 ml of methylene chloride is added at room temperature to 10 g of air-drying alkyd resin (60% by weight in xylene) containing 38%, by weight, of conjugated unsaturated fatty acids, corresponding to an oil content (calculated as triglyceride) of 42% by weight and the mixture is left to stand for 15 minutes.

Glass rods having a diameter of 8 mm and a length of 250 mm are coated with the prepolymer solution containing Pd by a dipping process as described in Example 15, dried in a drying cupboard at 80° C. for 4.5 hours and then nickel plated as in Example 1. After a chemical metallizing time of ca. 6 minutes, the rods are covered with a layer of nickel.

EXAMPLE 11

The prepolymer containing Pd mentioned in Example 16 is applied by screen printing to a glass fibre reinforced epoxide resin plate (150×50 mm), and the prepolymer mask is then cured in a drying cupboard at 50° C. for 8 hours and nickel plated according to Example 1.

A layer of nickel ca. 0.2 μm in thickness is found to have been deposited after 6 minutes.

This nickel layer is galvanically reinforced to 5 μm by connecting the plate as cathode in an acid copper plating bath as described in Example 1.

EXAMPLE 12

0.25 g of benzonitrile palladium dichloride are dissolved in 60 ml of ethanol. 26 ml of emulsifier-free polybutadiene latex are added to this solution at room temperature.

The latex has a solids content of 31.5%, by weight, with a gel content of 100% by by weight, a pH of 6.6 and an average particle diameter of 0.285 μm. Its swelling index in toluene is 5.0.

Foils (40×80 mm) are prepared from the latex by casting on glass plates. The foils are tempered for 8 hours in a drying cupboard at 50° C. and then nickel plated according to Example 1. After ca. 20 minutes, a nickel layer of 0.15 μm is obtained.

EXAMPLE 13

0.7 g of acetonitrile palladium dichloride are dissolved in 60 ml of ethanol. The solution is mixed with 26 ml of a polybutadiene latex at room temperature. The average particle diameter of the cross-linked polymer is 0.260 μm. The solids content of the latex is 31.5%, by weight, with a gel content of 98.7% by weight. The swelling index in toluene is 8.0. Foils (40×50 mm) prepared from the latex by casting on glass plates are cross-linked by exposure to a source of light (λ=245 nm) for 1 hour, and are then nickel plated according to Example 1.

A glossy electrically conductive nickel layer is obtained after from 4 to 6 minutes.

EXAMPLE 14

0.8 g of isobutyl vinyl ether palladium dichloride are dissolved in 20 ml of dimethyl formamide. The solution is added dropwise at room temperature in the course of 45 minutes to 7.8 g of a polybutadiene latex in 17 ml of water, which has an average particle diameter of 1.181 μm and a gel content of 100% by weight and the mixture is stirred for 2 hours at room temperature. Foils (40×50×10 mm) are produced from the latex by casting on glass plates and drying in the drying cupboard at 35° C. for 6 hours. These plates are exposed to a lamp (λ=254 nm) for 60 minutes and then nickel plated according to Example 1. The foil begins to turn black after 45 seconds and becomes covered with an electrically conductive nickel layer in the course of 12 minutes.

EXAMPLE 15

0.6 g of 4-cyclohexene-1,2-dicarboxylic acid anhydride palladium dichloride are dissolved in 30 ml of methanol. The solution is added dropwise in the crouse of 30 minutes at 35° C. to an emulsifier-free latex of 8.82 g of polybutadiene in 24.18 ml of $H_2O$ which has an average particle diameter of 0.275 μm and a gel content of 90.4% by weight and the mixture is stirred for 45 minutes.

Moulded articles 28 mm in diameter and 1.8 mm in height are obtained from the latex by casting into a glass beaker and then tempering in a drying cupboard at 40° C. The pieces are exposed to a UV lamp (366 nm) for 90 minutes and then nickel plated as in Example 1.

A nickel layer ca 0.25 μm in thickness has been deposited after 15 minutes.

The electric resistance of this chemical nickel layer is so low that the metallized composite material of metal and polymer is connected as cathode in an acid copper plating bath to be reinforced to 15 μm.

EXAMPLE 16

A 100×100 mm square of heat-resistant polycarbonate foil 3 mm in thickness is sprayed with a solution of 0.6 g of 4-cyclohexene-1,2-dicarboxylic acid anhydride in 20 ml of n-butanol and 5 of prepolymer solution according to Example 15, is cured in a drying cupboard at 95° C. for 10 minutes after evaporation of the solvent and is then nickel plated according to Example 1. After ca. 5 minutes, the nickel layer has a thickness of ca. 0.2 μm. The sample is taken from the bath, carefully rinsed with distilled water and reinforced with a copper layer 7.5 μm in thickness at 1.2 Amp. as described in Example 1.

EXAMPLE 17

5 g of a prepolymer solution in 10 ml of methyl ethyl ketone prepared as in Example 15 are added at room temperature to 40 ml of a 7.5%, by weight, chlorinated polybutadiene solution in toluene. 0.5 g of 4-cyclo-hexene-1,2-dicarboxylic acid anhydride palladium dichloride in 5 ml of methyl ethyl ketone is added dropwise to the solution in the course of 20 minutes. A carefully cleaned polycarbonate foil (80×30 mm) 1.5 mm in thickness is briefly dipped into the prepared coating solution, suspended vertically in the drying cupboard for 10 minutes to harden the coating and evaporate off the solvent and then nickel plated as in Example 1. A nickel coating 0.150 μm in thickness is obtained after 6 minutes.

EXAMPLE 18

0.5 g of 1,4-cyclohexene-1,2-dicarboxylic acid anhydride in 10 ml of methyl ethyl ketone is added at room temperature in the course of 10 minutes to 10 g of air-drying alkyd resin (60% by weight in xylene) having an oil content (calculated as triglyceride) of 26%.

A template for producing printed circuits is placed on a 200×200 mm polyhydantoin foil. The sample is sprayed with the coating solution ("Frigen" as propellant). After evaporation of the solvent, the template is removed from the surface of the foil, the lacquer layer is hardened in the drying cupboard at 50° C. for 5 hours and the foil is then nickel plated as in Example 1.

After 15 minutes, the sample is removed from the metallizing bath and the partial nickel coating is reinforced to 5 μm in a galvanic copper plating bath at 0.9 Amp./$dm^2$.

EXAMPLE 19

0.4 of 4-cyclohexene-1,2-dicarboxylic acid anhydride palladium dichloride in 5 ml of methylene chloride is added at room temperature to 32.2 g of a lacquer (15% by weight in xylene) based on 1.4-polyisoprene with diazole cross-linking agents in the course of 1 hour with stirring and under nitrogen.

A glass fibre reinforced epoxide resin plate measuring 25×80 mm and 1.5 mm in thickness is coated by immersion with the lacquer described above and after evaporation of the solvent the plate is exposed to a mercury lamp for 15 minutes and nickel plated as in Example 1.

After approximately 25 minutes, the nickel deposit is sufficiently thick to be able to be reinforced in a galvanic copper plating bath.

EXAMPLE 20

4 g of butadiene palladium dichloride are polymerised with 0.25 g of azodiisobutyric acid nitrile in 100 ml of anhydrous toluene with stirring at 60° C. under a nitrogen atmosphere.

Polymerization is stopped after 3 hours and the solvent is evaporated off under vacuum at 35° C. 29 g of commercial polystyrene are added to the sticky polymer mass. A moulding having a diameter of 12.9 mm and a thickness ca. 2.0 mm is formed from the polymer mixture in a cylindrical chamber at 100° C. and 1 bar.

This moulding is nickel plated as in Example 1. After ca. 6 minutes, the nickel layer has a thickness of ca 0.15 μm.

EXAMPLE 21

A piece of polyamide floor carpet measuring 12.5×16.5 cm is sprayed on its under surface with a solution of 8.5 g of polybutadiene containing Pd and having a number average molecular weight of $\overline{M}_n = 1100$ and a palladium content of 5.8%, by weight, (based on the dry polybutadiene mass) in 0.5 l of methylene chloride, and the carpet is then dipped into an aqueous alkaline copper plating bath containing 10 g of $CuSO_4$, 15 g of Rochelle salt and 20 ml of a 30%, by weight, formaldehyde solution per liter and adjusted to a pH of from 12 to 13 using 40%, by weight, sodium hydroxide solution.

A layer of nickel is found on the underside of the carpet after only 4 minutes.

The organometallic compounds used in the Examples are prepared as follows:

4-cyclohexene-1,2-dicarboxylic acid anhydride-palladium (II) chloride 4-cyclohexene-1,2-dicarboxylic acid anhydride is dissolved in three times the amount of dimethyl formamide, and an equimolar quantity of acetonitrile palladium dichloride is added in the course of 2 hours at 40° C. Dimethylformamide and acetonitrile are distilled off at 45° C./25 mbar. A brownish solid melting at from 53° to 54° C. is obtained in 90% yield. Isobutyl vinyl ether palladium dichloride is prepared analogously from acetonitrile palladium dichloride and isobutyl vinyl ether, melting point 57°-60° C.

Polybutadiene containing Pd

Acetonitrile palladium dichloride is dissolved in methylene chloride to prepare a 5%, by weight, solution. Oligomeric polybutadiene is added and the reaction mixture is stirred for 30 minutes at room temperature and freed from solvent and acetonitrile by evaporation under vacuum.

Butadiene palladium dichloride

Acetonitrile palladium dichloride is dissolved in methylene chloride to prepare a 5%, by weight, solution. Butadiene is introduced and the solvent and acetonitrile are distilled off under vacuum.

We claim:

1. Process for the activation of substrate surfaces for currentlless metallization, comprising wetting the surface to be metallized with a palladium-II organic compound dissolved in a solvent, removing the solvent and reducing the palladium-II organic compound adhering to the surface to be metallized, wherein (a) the organic moiety of the palladium-II organic compounds is an oligomeric, prepolymeric or polymeric compound of conjugated dienes or an unsaturated polyester and (b) the complex is formed by reaction of organic metallic compounds with said oligomeric, prepolymeric or polymeric compound, said reaction being accompanied by ligand exchange.

2. Process according to claim 1, characterised in that the oligomeric, prepolymeric or polymeric compound has a molecular weight of from 150 to 1,000,000.

3. Process according to claim 1, characterised in that the organometallic compounds are dissolved in a polar, protic or aprotic organic solvent in a quantity of from 0.01 to 10 g per liter.

4. Process according to claim 1, characterised in that reduction and metallization take place simultaneously.

5. Process according to claim 1, wherein the duration of the action of palladium-II organic compound dissolved in the solvent on the surface to be metallized is from 1 second to 10 minutes.

6. Process according to claim 1, wherein the organic moiety is selected from the group consisting of styrenebutadiene co-polymers and unsaturated polyesters.

7. Process according to claim 1, wherein the reduction is carried out in a metallizing bath using a reducing agent as for currentless metallization.

8. Process according to claim 1, wherein said solvent is an organic solvent.

* * * * *